US007845115B2

(12) United States Patent
Ponert et al.

(10) Patent No.: US 7,845,115 B2
(45) Date of Patent: Dec. 7, 2010

(54) ACCESS CONTROL APPARATUS

(75) Inventors: Gregor Ponert, Salzburg (AT); Kurt Wallerstorfer, Irrsdorf (AT)

(73) Assignee: Skidata AG, Gartenau (AT)

( * ) Notice: Subject to any disclaimer, the term of this patent is extended or adjusted under 35 U.S.C. 154(b) by 139 days.

(21) Appl. No.: 11/513,823

(22) Filed: Aug. 31, 2006

(65) Prior Publication Data

US 2008/0120909 A1 May 29, 2008

(51) Int. Cl.
*E06B 11/08* (2006.01)

(52) U.S. Cl. ..... 49/47; 49/46; 49/26; 49/35

(58) Field of Classification Search ..... 49/31, 49/32, 42, 44, 45, 46, 47, 49, 263, 267, 26, 49/35

See application file for complete search history.

(56) References Cited

U.S. PATENT DOCUMENTS

| | | | | |
|---|---|---|---|---|
| 79,911 | A * | 7/1868 | Huntington et al. | 235/93 |
| 3,386,202 | A * | 6/1968 | Crews et al. | 49/35 |
| 3,478,467 | A * | 11/1969 | May | 49/35 |
| 3,609,914 | A * | 10/1971 | Berl | 49/5 |
| 3,790,945 | A * | 2/1974 | Fearon | 340/572.2 |
| 3,988,570 | A * | 10/1976 | Murphy et al. | 235/382 |
| 4,060,039 | A * | 11/1977 | Lagarrigue | 109/3 |
| 4,195,442 | A * | 4/1980 | Keeling et al. | 49/35 |
| 4,785,580 | A * | 11/1988 | Olesen | 49/44 |
| 5,056,261 | A * | 10/1991 | Tetherton | 49/47 |
| 5,072,543 | A * | 12/1991 | Tetherton | 49/47 |
| 5,146,711 | A * | 9/1992 | Gallenschutz et al. | 49/46 |
| 5,622,006 | A | 4/1997 | Collins | |
| 6,012,252 | A * | 1/2000 | Kocznar et al. | 49/46 |
| 6,044,586 | A | 4/2000 | Wotke | |
| 6,170,194 | B1 * | 1/2001 | Kocznar et al. | 49/46 |
| 6,617,960 | B1 * | 9/2003 | Fischer et al. | 340/5.7 |
| 6,715,234 | B1 * | 4/2004 | Libardi | 49/42 |
| 6,720,874 | B2 * | 4/2004 | Fufido et al. | 340/541 |
| 6,945,303 | B2 * | 9/2005 | Weik, III | 160/188 |
| 7,076,083 | B2 * | 7/2006 | Blazey | 382/100 |
| 7,135,980 | B2 * | 11/2006 | Moore et al. | 340/573.1 |

(Continued)

FOREIGN PATENT DOCUMENTS

DE 200 09 698 U1 10/2000

(Continued)

OTHER PUBLICATIONS

U.S. Appl. No. 11/157,209, Applicant: Kurt Wallerstorfer, et al., filed Jun. 20, 2005 entitled Rotating Barrier.

(Continued)

*Primary Examiner*—Katherine W Mitchell
*Assistant Examiner*—Catherine A Kelly
(74) *Attorney, Agent, or Firm*—Flynn, Thiel, Boutell & Tanis, P.C.

(57) ABSTRACT

An access control apparatus has a blocking device (1) that is actuated by an actuator, and an authentication reader (7), upon reading a valid access authorization the blocking device (1) moving into the release position. For detecting a wheel chair (15) and/or pram in the area of the blocking device (1) a sensor (13) is provided, which does not activate the actuator for moving the blocking device (1) from the release position into the blocking position until the wheel chair (15) or pram has left its detection area.

14 Claims, 1 Drawing Sheet

U.S. PATENT DOCUMENTS

Figure 1:
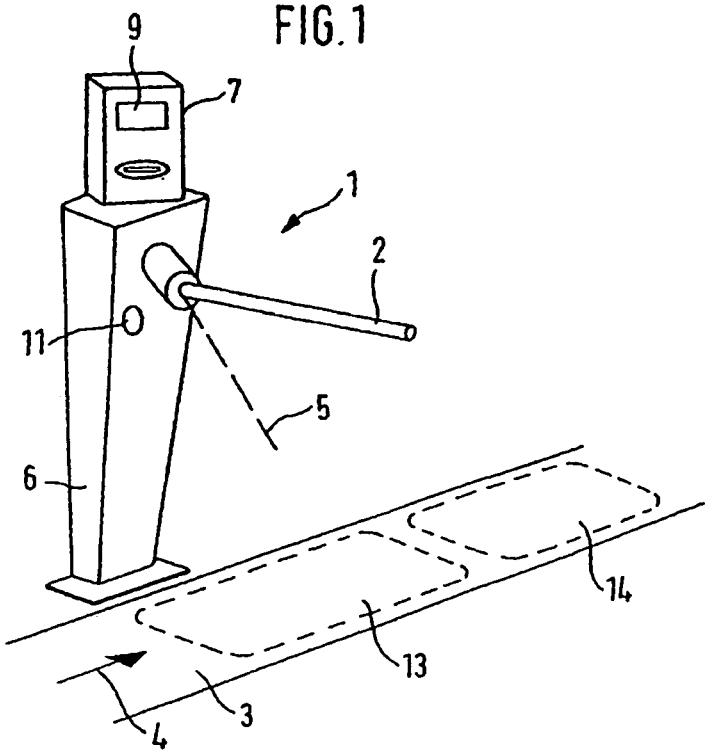

| | | | | |
|---|---|---|---|---|
| 7,392,617 | B2 * | 7/2008 | Wallerstorfer et al. | 49/47 |
| 2005/0122076 | A1 * | 6/2005 | Patchell et al. | 318/280 |
| 2005/0141997 | A1 * | 6/2005 | Rast | 416/229 R |
| 2006/0000144 | A1 * | 1/2006 | Wallerstorfer et al. | 49/47 |
| 2006/0101716 | A1 * | 5/2006 | Vandyck et al. | 49/35 |
| 2006/0150872 | A1 * | 7/2006 | Mesinger | 109/8 |
| 2006/0164240 | A1 * | 7/2006 | Patchell | 340/552 |
| 2008/0038055 | A1 * | 2/2008 | Jankovsky | 404/6 |

FOREIGN PATENT DOCUMENTS

| | | | |
|---|---|---|---|
| EP | 0 655 546 | A2 | 10/1994 |
| EP | 0 804 676 | B1 | 4/2002 |
| EP | 1 416 116 | A1 | 5/2004 |
| WO | WO 9425720 | A1 * | 11/1994 |

OTHER PUBLICATIONS

European Patent Office Search Report dated Aug. 24, 2005.

* cited by examiner

ACCESS CONTROL APPARATUS

The invention relates to an access control apparatus having a blocking device that is activated via a control system by an authentication reader to move the blocking device from a blocking position to a release position.

Such access control apparatuses are already known. The blocking device often consists of a turning blocking device with a rotatable rotating element. According to EP 0 804 676 B1 the rotating element can have only one single barrier arm rotatable between the individual blocking positions through 360 degrees. After a valid access authorization has been read, the barrier arm is turned by the actuator in a first partial turn from the blocking position downward into the release position. Furthermore, a people sensor is provided, which activates the actuator in such a way that on detecting a person in the area of the blocking device the barrier arm in a second partial turn again is moved into the blocking position.

Access control apparatuses are used e.g. in stadiums, fairs, public swimming pools, amusement parks and a multiplicity of further institutions, which are visited, among others, by wheel chair users or by persons with small children in prams. Since a turnstile or similar turning blocking device cannot be passed with a wheel chair or pram, beside the turnstile being the main entrance a separate entrance for wheel chair users and for persons with children has to be provided, e.g. a motor-driven swinging door. For manually actuating the blocking device at the separate entrance a checking person has to be assigned.

While the main entrance with the turnstile can be passed by the persons going through only when a valid authorization has been determined by the access authorization reader, at the separate entrance such automatic check does not take place. Apart from additional personnel expenses for the checking person such a separate entrance has the disadvantage that it can be misused by inattention or with the agreement of the checking person.

Therefore, it is the problem of the invention to provide a personal access control apparatus having a blocking device, which without any greater additional effort also permits access control for wheel chairs and prams.

This is achieved according to the invention by the access control apparatus characterized in claim 1. Advantageous embodiments of the invention are specified in the subclaims.

According to the invention the blocking device is moved into the release position, when the access authorization reader has read a valid access authorization and subsequently activates the actuator accordingly. When a person without wheel chair or pram passes the entrance, preferably he is detected by a people sensor that activates the actuator in such a way that the blocking device is moved into the blocking position not until the person has passed the released blocking device.

A wheel chair or pram is detected by the sensor for the detection of wheel chairs or prams provided according to the invention, and said sensor activates the actuator in such a way that the blocking device is not moved into the blocking position until the wheel chair or the pram has left the detection area of this sensor.

Therefore, according to the invention only one single entrance is required as to reliably check both walking persons and wheel chair users or pram pushing persons. I.e., a separate entrance for wheel chairs and prams is no longer necessary. Moreover, headcount saving can be achieved because personnel for checking the separate access is no longer needed. Since the blocking device allows access only upon the access authorization reader reads a valid access authorization, wheel chair users as well as walking persons are checked.

For detecting a wheel chair or pram one or a plurality of optoelectronic sensors such as light scanners or light barriers can be used, their detection areas being adapted such that they are able to distinguish between a wheel chair or pram and a walking person. An electronic picture processing system allowing such differentiation can also be used. But since a wheel chair or pram largely consists of metal, an inductive sensor for the detection of wheel chairs and/or prams is especially preferred. Here the inductive sensor can be formed as an induction loop that is embedded in the bottom of the entrance lane in the area of the blocking device.

The blocking device cannot allow access before the people sensor detects a person, a wheel chair or pram. But substantial is that in case of a wheel chair or pram the blocking device does not take up its blocking position before the wheel chair or pram has passed the entrance lane such that it cannot be blocked by the closing blocking device. Therefore, according to the invention the actuator is not activated as to move the blocking device from the release position into the blocking position by the sensor for the detection of wheel chairs and/or prams until the wheel chair or pram has left the detection area of the wheel chair and/or pram sensor. As to ensure that the closing blocking device does not block the wheel chair or pram, different measures can be taken. The detection area of the wheel chair and/or pram sensor in relation to the area of the blocking device can be adapted such that the wheel chair or pram has left the area of the blocking device before the blocking device closes. Furthermore, a time-oriented control system can be provided, so that the actuator does not close the blocking device before a predetermined period has passed after the wheel chair or pram had left the detection area of the sensor. Furthermore, it is possible to provide a second sensor for the detection of wheel chairs and/or prams arranged in the direction of passage after the first sensor for the detection of wheel chairs and/or prams, the actuator not closing the blocking device before the wheel chair or pram has reached the detection area of the second sensor.

A pram with a small child often can pass an access control apparatus without an access authorization for the small child being required. But usually adults in wheel chairs are not granted such privileged treatment. In those countries where a special treatment for handicapped people is considered a discrimination it is even impermissible to let wheel chair users pass an access being subject to charges without having an access authorization. Therefore, there is the problem that persons pushing a pram must be allowed to pass the access control apparatus with only one access authorization, whereas for persons pushing a wheel chair the access is only released upon reading a valid access authorization for the wheel chair user and a valid access authorization for the person pushing the wheel chair. But in practice this problem is of minor importance. Adult wheel chair users are used to buy an access authorization for themselves, so that the exceptional case, that the wheel chair user does not have an access authorization can be accepted.

I.e., when a pram or a wheel chair reaches the passageway, on reading the access authorization of only one person the blocking device is moved into the release position, it remaining in the release position until the pram or wheel chair has left the detection area of the sensor for the detection of wheel chairs and/or prams and in addition the pushing person has left the detection area of the people sensor. Not until then the blocking device is moved from the release position into the blocking position.

If there is to be excluded, that an adult wheel chair user and the person pushing the wheel chair can pass the passageway with only one access authorization, in contrast to a small child in a pram and the person pushing the pram, there can be provided a device for classifying between a pram with a small child and a wheel chair with an adult person, for example with the help of a balance disposed in the entrance lane. The classification device can also be formed by a picture recording unit with downstream picture processing system and picture evaluation. Besides, the people sensor can be formed in the same way as the classification device.

The actuator preferably is a motor, in particular an electromotor. But it can also be formed e.g. by a solenoid, a piston/cylinder unit actuatable by a pressure medium, e.g. compressed air, or by another drive.

The access control apparatus according to the invention can be formed as a turning blocking device. For example, a turning star with two barrier arms, offset by about 120 degrees or 240 degrees, is used. But preferably the turning star has only one barrier arm. The rotation axis of the turning blocking device can be arranged vertical, but for space-saving reasons preferably a turning star is used, the rotation axis of which in relation to the horizontal line is inclined by 30 degrees to 60 degrees, preferably 40 degrees to 50 degrees. The angle of the barrier arm in relation to the rotation axis of the turning star preferably is 30 degrees to 60 degrees, in particular 40 degrees to 50 degrees. In its downward release position the barrier arm extends into the passageway with a maximum angle of 10 degrees in relation to the vertical. If the turning star has two turning arms, the two turning arms enclose an angle of about 120 degrees.

When a turning star with only one barrier arm is used, between two blocking positions the angle of rotation of the barrier arm is 360 degrees. If a valid access authorization is read, the single barrier arm in a first partial turn is turned from the blocking position from the top to the bottom into the release position. The rotation angle of the first partial turn can range between 90 degrees to 270 degrees, in particular 110 degrees to 250 degrees. After the wheel chair or pram has left the detection area of the sensor for the detection of wheel chairs and/or prams the barrier arm is turned onward in a second partial turn in order to again take up the blocking position. A person pushing a pram or a wheel chair is detected as such by a simultaneous response or a response of the sensor for the detection of wheel chairs and/or prams and shortly thereafter the response of the people sensor, so that the barrier arm remains in the release position until the pushing person has reached at least a position from which the barrier arm can push onward the person with the second partial turn. It is not necessary to completely exclude the possibility that the barrier arm does not come into contact with the pushing person during the second partial turn, in particular when the rotating speed of the second partial turn is limited. Slightly touching the pushing person does hardly impede the comfort of this person, but has the advantage, that for psychological reasons the passage speed of the person pushing the wheel chair or pram is increased. For the same reason a wheel chair user may be pushed onward by the barrier arm during the second partial turn.

In case of a walking person, who neither pushes a pram nor a wheel chair, the barrier arm remains in the release position as long as the people sensor has detected, that the person has reached at least a position where he is touched by the barrier arm at most in the second partial turn in order to push him onward.

The access authorization reader can be formed by a non-contacting reader, in particular for reading RFID transponders with access authorization stored thereon. But it can also be a dip reader for example for magnetic cards, bar code cards, chip cards or similar cards. The people sensor can be formed, for example, as an optoelectronic sensor.

In the following an embodiment of the access control apparatus according to the invention is explained in more detail by way of example with reference to the attached Figure.

Figure 2:
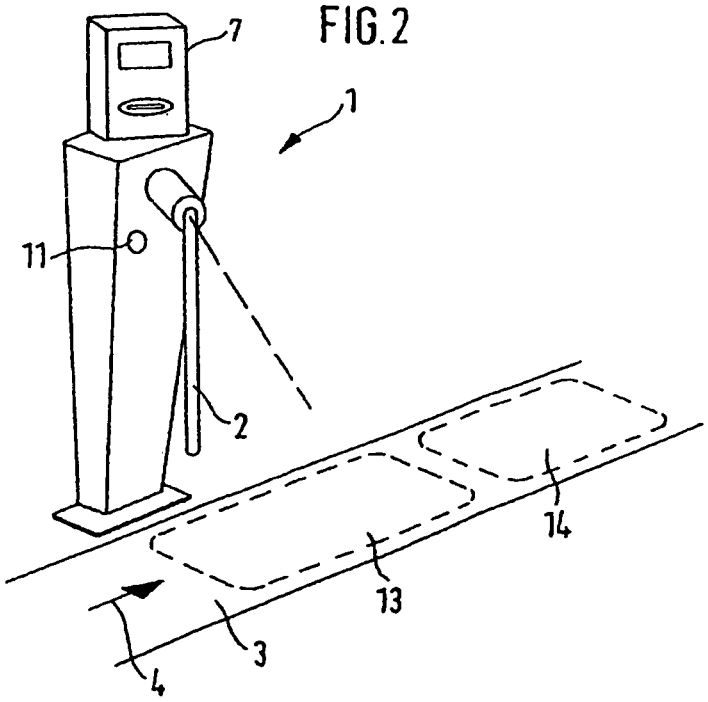
Figure 3D:
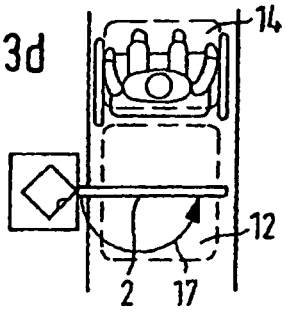

FIGS. 1 and 2 schematically show a perspective depiction of the access control apparatus in the blocking or release position; and FIGS. 3*a* through 3*d* show a schematic plan view onto a wheel chair user, who approaches the control apparatus (FIG. 3*a*), they show the wheel chair user when inserting an access authorization ticket into the reader of the access control apparatus (FIG. 3*b*), when passing the access control apparatus (FIG. 3*c*), and after the passage of the access control apparatus that is in the next blocking position (FIG. 3*d*).

According to FIGS. 1 and 2 access control apparatus has blocking device 1 in the form of a turning star, which is driven by a not shown electromotor as an actuator. Blocking device 1 is provided with barrier arm 2 for blocking passageway 3, which is passed in the direction of the arrow 4.

Blocking device 1 has rotation axis 5, which in relation to the horizontal line is inclined by about 45 degrees. The angle enclosed by barrier arm 2 and rotation axis 5 is about 45 degrees. While barrier arm 2 in the blocking position according to FIG. 1 is turned into a roughly horizontal position and thus blocks access 3, in the release position according to FIG. 2 it is turned perpendicularly downwards, so that access 3 is released.

Access control apparatus has a frame with housing 6, wherein actuator or rotary drive, i.e. electromotor and transmission unit, and electronic control system are disposed. On housing 6 is disposed further housing 7, wherein is provided a dip reader as an access authorization reader e.g. for magnetic cards with access authorization stored thereon, which via card mouth 8 are inserted into the dip reader. Display 9 in housing 7 gives information to the user, e.g. "Gate Open".

Figure 3C:
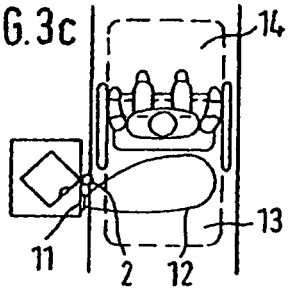
Figure 3B:
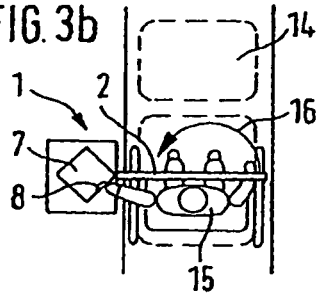
Figure 3A:
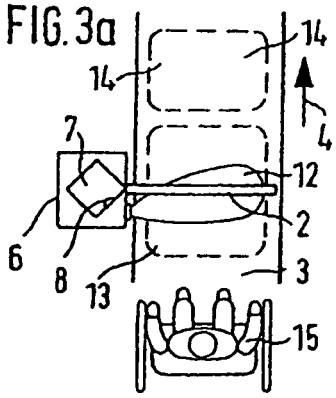

Furthermore, in housing 6 is provided an optoelectronic sensor as a people sensor 11, the detection area 12 of which is shown in FIGS. 3*a*, 3*c* and 3*d*, but for clarity's sake has been omitted in FIG. 3*b*.

Into the bottom of the entrance lane 3 are embedded a first and a second induction loop as a first sensor 13 and second sensor 14 for the detection of wheel chairs and prams.

When wheel chair user 15 approaches passageway 3 according to FIG. 3*a*, barrier arm 2 is in a blocking position (FIG. 1). After the card has been inserted into the card mouth 8 according to FIG. 3*b* and the reading unit has read a valid card, the motor or the transmission unit is activated such that barrier arm 2 in a first partial turn according to arrow 16 is turned forward and downward into the release position (FIG. 2). Wheel chair user 15 according to FIG. 3*c* here is on the first sensor 13 for the detection of wheel chairs and prams, which activates the motor or the motor transmission such that barrier arm 2 remains in the release position. When wheel chair user 15 according to FIG. 3*d* has left first sensor 13 and reaches second sensor 14, blocking device 1 is activated such that barrier arm 2 in a second partial turn is turned upward according to arrow 17 from the release position into the new blocking position.

When wheel chair user 15 is pushed by a (not shown) person, this person is detected by people sensor 11, the detection area 12 of which is adapted such that barrier arm 2 remains in the release position until the pushing person has reached at least the position where barrier arm 2 can push him onward with the second partial turn. In case of a (not shown) walking person (without wheel chair or pram) barrier arm 2 after having read a valid access authorization remains in the release position until the person has reached at least the position in which barrier arm 2 can push him onward with the second partial turn.

The invention claimed is:

1. A personal access control apparatus for checking both walking persons and wheel chair users or persons pushing prams through a single passageway having one direction of travel, wherein the walking persons, wheelchair users, and people pushing prams travel on an entrance lane surface, the personal access control apparatus comprising a blocking device having a barrier arm, which is activated by an actuator controlled via a control system, and an authentication reader, wherein upon reading a valid access authorization the blocking device is moved from a blocking position into a release position by actuating the actuator, the access control apparatus further comprising a wheel chair and/or pram sensor including a continuous induction loop that is embedded below the entrance lane surface and below the barrier arm in the blocking position, a first end of the induction loop being disposed along the direction of travel before the barrier arm when the barrier arm is in the blocking position and a second end of the induction loop being disposed after the barrier arm along the direction of travel whereby the first and second ends define a first area adjacent the blocking device, the wheel chair and/or pram sensor for distinguishing the presence of a wheel chair and/or pram in the first area adjacent the blocking device from the presence of a person, wherein the wheel chair and/or pram sensor does not activate the actuator so as to move the barrier arm from the release position into the blocking position until the wheel chair and/or the pram has left the area of the induction loop, and a people sensor for controlling the actuator so that the blocking device remains in the release position after the wheel chair and/or pram has left the area of the induction loop as long as a person is in a detection area of the people sensor.

2. The personal access control apparatus according to claim 1, wherein the actuator for moving the blocking device into the blocking position is activated to move the blocking device to the blocking position a predetermined period of time after the wheel chair and/or pram has left the area of the wheel chair and/or pram sensor so long as the presence of a person is not detected by the people sensor.

3. The personal access control apparatus according to claim 1, wherein the sensor having the induction loop for distinguishing the presence of a wheel chair and/or pram from a person comprises a first sensor, and wherein a second sensor for distinguishing the presence of a wheel chair and/or pram from a person is located after the first sensor in the direction of passage, and wherein after the first sensor determines the presence of a wheel chair and/or pram, the actuator for moving the barrier arm of the blocking device into the closed position is not activated until the presence of the wheel chair and/or pram is subsequently sensed by the second sensor.

4. The personal access control apparatus according to claim 1, wherein the people sensor comprises an optoelectronic sensor.

5. The personal access control apparatus according to claim 1, wherein the people sensor comprises a picture recording unit with a downstream picture processing system and picture evaluation.

6. The personal access control apparatus according to claim 1, wherein the blocking device comprises a turning blocking device for turning the barrier arm.

7. The personal access control apparatus according to claim 6, wherein the barrier arm comprises a single barrier arm, and wherein the single barrier arm is turned between the individual blocking positions by 360 degrees and a rotation axis of the turning blocking device in relation to the horizontal line is inclined by 30 degrees to 60 degrees.

8. The personal access control apparatus according to claim 6, wherein the barrier arm comprises a first barrier arm and the turning blocking device includes a second barrier arm, wherein the first and second barrier arms are disposed offset one above the other by about 120 degrees and about 240 degrees.

9. The personal access control apparatus according to claim 7, wherein the single barrier arm and the rotation axis of the turning blocking device enclose an angle of 30 degrees to 60 degrees.

10. The personal access control apparatus according to claim 7, wherein upon reading a valid access authorization, the access authorization reader activates the actuator in such a way that the single barrier arm in a first partial turn is turned downward from the blocking position into the release position and the actuator for turning the barrier arm in a second partial turn into the blocking position is not activated before the wheel chair and/or pram has left the detection area of the wheel chair and/or pram sensor for distinguishing the presence of wheel chairs and/or prams from the presence of a person.

11. The personal access control apparatus according to claim 10, wherein a partial turn of the barrier arm from the blocking position downward into the release position is from 90 degrees to 270 degrees.

12. A personal access control apparatus for detecting walking persons, wheel chair users and persons pushing prams along a passageway having a single direction of travel wherein the walking persons, wheelchair users, and people pushing prams travel on an entrance lane surface, comprising:

a blocking device including a barrier arm having a blocking position and a release position for use with a passageway having an entrance side and an exit side;

an actuator for operating the blocking device;

an authentication reader for reading a valid access authorization and providing an authentication output;

a people sensor for sensing the presence of a person within a detection area and providing a people sensor output, wherein a portion of the detection area is disposed on the entrance side of the barrier arm when the barrier arm is in the blocking position;

a first wheel chair and/or pram sensor comprising a continuous induction loop that is embedded below the entrance lane surface for distinguishing the presence of a wheel chair and/or pram in a first area adjacent the blocking device from a person and providing a first sensor output, a first end of the induction loop extending beyond the blocking device toward the entrance side and a second end of the induction loop extending beyond the blocking device toward the exit side of the passageway; and a control system for controlling the actuator for the blocking device, the control system receiving the authentication output, the people sensor output, and the first sensor output, wherein the control system controls the actuator to move the blocking device to the release position after receiving the authentication output indicating that a valid access authorization has been received, wherein, in response to the people sensor output, the control system prevents the actuator from moving the blocking device from the release position to the blocking position so long as a person is sensed in the detection area by the people sensor, and wherein, in response to the first sensor output, the control system prevents the actuator from moving the blocking device from the release position to the blocking position until the wheel chair and/or the pram has left the first area of the blocking device and the people sensor does not sense the presence of a person in the detection area.

13. The personal access control apparatus of claim 12, further comprising a second wheel chair and/or pram sensor for distinguishing the presence of a wheel chair and/or pram from a person in a second area, wherein the second area of the second sensor is spaced outwardly away from the first sensor toward the exit side of the blocking device, and wherein the control system prevents the actuator from moving the barrier arm of the blocking device from the release position to the blocking position for a wheel chair and/or pram that is sensed by the first sensor, until the presence of the wheel chair and/or pram is no longer sensed by said first sensor, the presence of the wheel chair and/or pram is subsequently sensed by the second sensor, and the people sensor does not sense the presence of a person in the detection area.

14. The personal access control apparatus according to claim 13, wherein the second sensor for distinguishing the presence of a wheel chair and/or pram from a person comprises an inductive loop disposed in the passageway.

* * * * *